United States Patent [19]

Cline et al.

[11] 4,433,697

[45] Feb. 28, 1984

[54] WRAPPER FOR SMOKING ARTICLES AND METHOD

[75] Inventors: Warren K. Cline, Brevard; William F. Owens, Pisgah Forest, both of N.C.

[73] Assignee: Olin Corporation, Pisgah Forest, N.C.

[21] Appl. No.: 366,314

[22] Filed: Apr. 7, 1982

[51] Int. Cl.[3] ..... A24D 1/02; A24D 1/18; A24B 3/14

[52] U.S. Cl. ..... 131/365; 131/359; 131/343; 131/352

[58] Field of Search ..... 106/209; 131/352, 334, 131/335, 365, 359, 343

[56] References Cited

U.S. PATENT DOCUMENTS

| | | | |
|---|---|---|---|
| 1,518,944 | 12/1924 | Sulzberger | 131/365 |
| 2,307,088 | 1/1943 | Whiteley | 131/365 |
| 2,733,720 | 2/1956 | Schur | 131/365 |
| 2,890,704 | 6/1959 | Lamm | 131/365 |
| 2,998,012 | 8/1961 | Lamm | 131/365 |
| 3,477,865 | 11/1969 | Armbrust et al. | 106/209 |
| 4,231,377 | 11/1980 | Cline et al. | 131/365 |

*Primary Examiner*—V. Millin

*Attorney, Agent, or Firm*—Kerkam, Stowell, Kondracki & Clarke

[57] ABSTRACT

A wrapper is provided for smoking articles such as cigarettes, cigars and the like having incorporated therein at least 1% by weight of certain ceramic fibers in the paper furnish in combination magnesium oxide and/or magnesium hydroxide fillers, whereby the combination acts to significantly reduce visible sidestream smoke emanating from the smoking article during static burning, and improves ashing. Wrappers made according to this invention may be made by incorporating the magnesium hydroxide, magnesium oxide and the other fillers in the wrapper pulp furnish containing the ceramic fibers or either or both of the fillers may be applied to the improved wrapper as a coating for the papers. In the case of cigarette papers, the ceramic fibers may be added to an ordinary paper furnish such as pulped wood or flax fibers. The furnish of fiber pulp and ceramic fibers and fillers are used to make a paper sheet on conventional papermaking machines.

20 Claims, No Drawings

WRAPPER FOR SMOKING ARTICLES AND METHOD

TECHNICAL FIELD

This invention relates generally to smoking articles such as cigarettes, cigars and the like and the wrapper for the tobacco column thereof, and more particularly to an improved wrapper for such smoking articles for use either by itself or as an inner wrapper in combination with a conventional outer wrapper.

BACKGROUND OF THE PRIOR ART

A common problem associated with smoking articles such as cigarettes or cigars is the amount of sidestream smoke that is given off during static burning, for example when the smoking article is idling and not being drawn upon by the smoker or is simply resting in an ashtray while burning. Visible sidestream smoke that is given off by a smoking article such as a cigarette during static burning is irritating and objectionable to non-smokers in the vicinity of the idling cigarette.

A problem with heretofor developed wrappers that produced low sidestream smoke has been that they give a flaky and/or off color ash due to poor ashing characteristics of the wrappers. Various mechanisms have been incorporated into smoking articles to reduce visible sidestream smoke and to improve the ashing characteristics of wrappers, but none to date has been commercially successful in overcoming both of these problems.

Probably the most effective means of reducing visible sidestream smoke, to date is disclosed and claimed in U.S. Pat. No. 3,231,377, Cline et al owned by applicant's assignee, Olin Corporation.

In this patent there is disclosed a wrapper for smoking articles such as cigarettes, cigars and the like containing at least 15% by weight magnesium oxide or its hydrate and at least 0.5% by weight of specific chemical adjuvant such as the alkali metal acetates, carbonates, citrates, nitrates or tartrates. The combination of magnesium oxide or its hydrate with any of the chemical adjuvants significantly reduces visible sidestream smoke that emanates during static burning from smoking articles employing the wrapper. The wrapper may comprise conventional cigarette paper with magnesium oxide and the adjuvant incorporated therein as the filler in the paper furnish or either or both of the additives may be applied to the paper as a coating. Wrappers containing the additives can be used in place of conventional wrappers for smoking articles or used as an inner wrapper for the tobacco column in combination with a conventional outer wrapping of cigarette paper or cigar wrap.

Following the teaching of this patent substantial and very desirable reduction in visible sidestream smoke can be achieved by using cigarette paper containing magnesium oxide as filler in combination with certain chemical adjuvants. These papers have consistently given a flaky ash and have been determined to be unacceptable for use by the cigarette manufacturers due to the poor ashing characteristics. Extensive testing has not identified any burning chemical or combination of burning chemicals which overcomes this problem.

Schur (in U.S. Pat. No. 2,733,720) discloses the use of minor amounts of asbestos fiber in certain cigarette papers to give more solid ash. These fibers would undoubtedly function to improve the ash from papers but are completely unacceptable for use in cigarettes in the light of present knowledge of inhalation hazards of asbestos. Similarly, Lamm (in U.S. Pat. Nos. 2,890,704 and 2,998,012) discloses cigarette wrappers made of interwoven glass fibers. It has been shown that glass fibers added to magnesium oxide paper give an acceptably solid ash. These, too, are unacceptable to the cigarette manufacturers.

BRIEF SUMMARY OF THE INVENTION

One purpose of this invention is to provide an improved magnesium oxide and/or magnesium hydroxide filled paper by incorporation in the paper certain inorganic fibers which solidify the ash and which at the same time do not constitute a health hazard to the smoker.

Another purpose of the present invention preserves all of the advantages provided by the invention disclosed and claimed in U.S. Pat. No. 4,231,377, Cline et al and in addition gives a still greater reduction in sidestream smoke and at the same time gives a more solid ash. This is highly desirable from the standpoint of those who are annoyed by smoke generated by others and for whom the ideal would be no smoke at all.

In general the invention consists in the incorporation of a small percentage of ceramic fibers selected from the group consisting of Saffil alumina, Fiberfrax aluminum silicate, Fiber FP polycrystalline alumina and HSA aluminum-silicate.

Saffil alumina is a fiber supplied by ICI America and Fiberfrax ceramic fiber is manufactured by Carborundum Company. Saffil is amorphous alumina with 5% silica impurity, none of it present in crystaline form. Fiberfrax is aluminum silicate with no crystalline silica. Both products are used in insulation and have been tested for inhalation hazard by their manufacturers. Neither caused any malignancy or other serious respiratory problems like those associated with asbestos. DuPont's Fiber FP, is greater than 99% pure polycrystalline alumina, and which is ideal for this application but is presently almost prohibitively priced.

At least about 1% by weight of the total fiber weight of the handsheets of the ceramic fiber would be required to give worth-while improvement in ash appearance. From about 2% to about 5% is required to achieve a completely solid ash. Higher levels could be used but probably would not justify the additional cost for the relatively expensive inorganic fibers.

HSA fiber is an aluminum-silicate product manufactured by the Carborundum Company and is chemically identical to Fiberfrax fiber. Physically, the two fibers differ in that HSA has been processed to remove large diameter fibers and most of the beads of ceramic material called "shot".

DETAILED DESCRIPTION OF THE INVENTION

In accordance with this invention, a cellulosic wrapper is provided for smoking articles such as cigarettes, cigars and the like having incorporated therein at least 1% by weight of certain ceramic fibers in the paper furnish in combination with magnesium oxide and/or magnesium hydroxide gel fillers whereby the combination acts to significantly reduce visible sidestream smoke emanating from the smoking article during static burning and improves ashing. Cellulosic wrappers made according to this invention may be made by incorporating magnesium hydroxide and/or magnesium oxide and other fillers such as calcium carbonate in the wrapper pulp furnish containing the ceramic fibers or either or both of the fillers may be applied to the improved wrapper as a coating. In the case of cigarette papers, the ceramic fibers are added to an ordinary paper furnish such as pulped wood or flax fibers. The furnish of fiber pulp, ceramic fibers and fillers are then used to make a paper sheet on conventional papermaking machines.

The ceramic fibers are added to fiber pulps customarily used to make cellulosic paper wrappers for cigarettes or the tobacco materials used to make cigar wrap. Thus, in addition to wood and flax fibers, the furnish may be pulped tobacco stalks or stems to which is added the ceramic fibers.

Smoking article wrappers containing the ceramic fibers and magnesium hydroxide gel and/or magnesium oxide with or without the other fillers according to this invention may be used as an inner wrapper under a normal outer wrapper for the tobacco column of the cigarette or cigar. Conventional cigarette paper, and preferably very porous or perforated cigarette paper, or cigar wrap may be used as the outer wrapping for the smoking article. Such a combination reduces the tobacco weight necessary to make a satisfactory product, increases the tobacco rod firmness, and does not alter the appearance of the cigarette or cigar. Wrappers containing the ceramic fibers and the additives according to this invention also may be used as the single wrap for smoking articles. With cigarettes, it is especially desirable to use high basis weight papers if only a single wrap is employed.

Reductions of at least 30% sidestream particulate matter yields are obtained in smoking articles in which wrappers according to this invention are employed and reductions of 70% or more can be achieved when compared with smoking articles with wrappers that do not contain either MgO or $Mg(OH)_2$ or ceramic fiber.

The following examples illustrate various aspects of the invention.

EXAMPLE I

Flax handsheets, 50 g/M$^2$ in basis weight, with 50% magnesium oxide filler were made with 5% Fiberfrax ceramic fibers based on the total weight of the sheet. This paper was treated with 3.5% sodium acetate solution. Cigarettes rerolled in the treated paper gave acceptable, solid ash and equally as much reduction in visible sidestream smoke as magnesium oxide paper with no added inorganic fiber.

EXAMPLE II

Saffil ceramic fibers in the long-fibered mat form in an amount sufficient to give 5% in the finished paper was added with gentle agitation to the furnish used to make the flax handsheets, 50 g/M$^2$ basis weight, with 50% magnesium oxide filler. Some of this paper treated with 3.5% sodium acetate solution was used to reroll cigarettes using Kentucky Referee 1R3 tobacco. These cigarettes gave a dark gray, solid ash which did not flake off. Sidestream tar yield averaged 8.8 milligrams per cigarette for about a 63% reduction compared to cigarettes wrapped in typical calcium carbonate filled paper.

EXAMPLE III

The effect of HSA ceramic fiber on sidestream smoke yield was demonstrated in a series of experiments in which flax handsheets containing a 2.5% HSA fiber were treated with 3% sodium acetate solution, used to reroll cigarettes and compared with cigarettes rerolled in similarly treated handsheets with the same basis weight, filler level and composition without HSA fiber. Results of sidestream tar determinations on these cigarettes are tabulated below:

| Paper Basis Weight (g/M$^2$) | Filler Content % Magnesium Oxide | Filler Content % Calcium Carbonate | HSA Fiber % | Sidestream Tar (mg/cigarette) |
|---|---|---|---|---|
| 100 | 35 | 0 | 0.0 | 11.0 |
| 100 | 35 | 0 | 2.5 | 9.3 |
| 100 | 50 | 0 | 0.0 | 9.7 |
| 100 | 50 | 0 | 2.5 | 9.4, 7.8 |
| 80 | 50 | 0 | 0.0 | 10.1 |
| 80 | 50 | 0 | 2.5 | 10.1 |
| 80 | 25 | 25 | 0.0 | 11.4 |
| 80 | 25 | 25 | 2.5 | 10.5, 10.8 |
| 90 | 40 | 20 | 0.0 | 9.8 |
| 90 | 40 | 20 | 2.5 | 9.7 |

Sidestream tar yields in this series averaged 5.9% less for the handsheets with HSA fiber than for the corresponding papers without HSA fiber.

EXAMPLE IV

Another series of experiments was carried out to confirm this effect and to study the relationship between the concentration of HSA fiber in the paper and sidestream tar yields. All of the handsheets in this series were made with flax from the same beater run, had basis weights of 100 g/M$^2$ and contained 50% magnesium oxide filler. The control with no HSA fiber was compared to other sets with 1%, 2.5%, 5% and 10% HSA fiber. All were treated with 3% sodium acetate. Sidestream tar yields on cigarettes rerolled in these papers are tabulated below:

| HSA Fiber % | Sidestream Tar (mg/cigarette) |
|---|---|
| 0.0 | 10.3, 10.1 |
| 1.0 | 6.4, 8.8 |
| 2.5 | 9.7, 8.8 |
| 5.0 | 8.9 |
| 10.0 | 8.1 |

In this series, sidestream yields averaged 17% less for the papers with the HSA fibers than for the control. It is surprising that this effect is achieved by using as little as 1% HSA fiber in the paper.

The mechanism by which the HSA fibers enhance sidestream reduction is not know. It is possible that their relatively small dimensions and consequent large surface area are important. As can be seen in the following tabulation, HSA fibers had the smallest average diameter of any of those tested:

| Fiber | Average Diameter (Micrometers) |
|---|---|
| HSA | 1.00 |
| Glass | 1.75 |
| Saffil | 3.00 |
| Fiberfrax W-758 | 3.00 to 4.00 |

EXAMPLE V

Fiberfrax W-758 is a commercial grade of ceramic fiber, chemically identical with HSA, which has been washed to remove some of the beads of ceramic material called "shot". Handsheets, 50 g/M$^2$ basis weight with 50% filler derived from a reactive grade of magnesium oxide and 2.5% of Fiberfrax W-758, were compared to a control with no ceramic fiber. Cigarettes were rerolled in these papers after treatment with 3.0% (A) and 3.5% (B) of sodium acetate. Results of sidestream tar determinations are listed below:

| | Sidestream Tar (mg/cigarette) | |
|---|---|---|
| | A | B |
| Fiberfrax W-758 | 13.1 | 15.0, 13.1 |
| Control | 12.4 | 14.5 |

EXAMPLE VI

In a series of similar tests using 100 g/m$^2$ handsheets with 50% magnesium oxide filler, Saffil alumina fibers at 2.5% and 5% and glass fibers from Cambridge filter material at 5% of the total sheet weight were compared to a control with no inorganic fiber. All of the papers were treated with 3% sodium acetate solution before being used to reroll the test cigarettes. As can be seen from the results tabulated below, neither of these fibers showed the beneficial effect on sidestream smoke reduction seen with HSA fiber:

| Fiber | Concentration In Paper % | Sidestream Tar Yield (mg/cigarette) |
|---|---|---|
| None (control) | 0.0 | 9.6 |
| Saffil | 2.5 | 10.0 |
| Saffil | 5.0 | 9.8 |
| Glass | 5.0 | 9.6 |

Thus while each of the ceramic fibers described herein have the beneficial property of substantially eliminating flaky ash problems in wrapped smoking products, to be useful also in reducing sidestream smoke, it would appear that the ash reinforcing fibers should be less than 1.5 micrometers in average diameter and preferably 1.0 micrometers or less.

EXAMPLE VII

Flax handsheets with basis weights of 100 g/M$^2$ filler, with and without HSA fiber, were treated with burning chemicals as indicated in the following table. They were then used to reroll matched weights of tobacco from Kentucky Referee 1R3 cigarettes for sidestream tar determination. The filler in these handsheets was composed of 75% MagChem 10 magnesium oxide and 25% of Merck's R-1458 magnesium hydroxide.

| Composition Of Burning Chemical Solution | HSA Fiber % | Sidestream Tar (mg/cigarette) | Average Burn Time (Minutes) |
|---|---|---|---|
| 3% Sodium Acetate | None | 12.6* | 9.2 |
| 3% Sodium Acetate | 2.5 | 12.2** | 8.5 |
| 10% Magnesium | None | 12.4 | 10.0 |

-continued

| Composition Of Burning Chemical Solution | HSA Fiber % | Sidestream Tar (mg/cigarette) | Average Burn Time (Minutes) |
|---|---|---|---|
| Acetate And 3% Sodium Acetate | | | |
| 10% Magnesium Acetate And 3% Sodium Acetate | 2.5 | 10.8 | 10.2 |

*Average of two tests, three cigarettes in each test.
**Average of three tests, three cigarettes in each test.

EXAMPLE VIII

Flax handsheets, 100 g/M$^2$ basis weight, were made to contain 50% filler consisting of 87% MagChem 10 magnesium oxide and 13% magnesium hydroxide. The magnesium hydroxide was precipitated as an amorphous gel by the reaction of magnesium acetate with sodium hydroxide in the presence of the flax fibers. As in Example 1, handsheets with and without ceramic fiber were treated with the indicated concentrations of burning chemical and used to reroll cigarettes for sidestream tests.

| Composition Of Burning Chemical Solution | HSA Fiber % | Sidestream Tar (mg/cigarette) | Average Burn Time (Minutes) |
|---|---|---|---|
| 4% Potassium Acetate | None | 10.1 | 12.9 |
| 4% Potassium Acetate | 2.5 | 8.5 | 13.9 |
| 6% Potassium Acetate | None | 9.6 | 13.9 |
| 6% Potassium Acetate | 2.5 | 8.6 | 12.6 |

At both levels of burning chemical, the paper with HSA fiber gave lower yields of sidestream tar.

EXAMPLE IX

Two sets of 50 g/M$^2$ flax handsheets were made with 50% total filler consisting of 87% MagChem 10 magnesium oxide and 13% colloidal magnesium hydroxide precipitated in the presence of the flax fiber by the reaction of sodium hydroxide with magnesium acetate. One set contained 2.5% HSA fiber and the other contained none. Paper from each set was treated with a range of burning chemical concentrations and the treated papers used to reroll cigarettes for sidestream tar tests. The results are tabulated below:

| Composition Of Burning Chemical Solution | Sidestream Tar (mg/cigarette) | |
|---|---|---|
| | Without HSA Fiber | With HSA Fiber |
| 3% Sodium Acetate | 16.7 | 15.3 |
| 2% Potassium Acetate | 16.2 | 16.2 |
| 4% Potassium Acetate | 13.7 | 14.2 |
| 6% Potassium Acetate | 14.4 | 13.2 |
| 8% Potassium Acetate | 14.1 | 12.6 |

In spite of the results with 2% potassium acetate and 4% potassium acetate, the overall average effect of the HSA fiber was to decrease sidestream tar yield by 0.8 milligram per cigarette.

EXAMPLE X

Two sets of 50 g/M$^2$ flax handsheets were made with 50% total filler just as in Example IX except that the filler consisted of 80% MagChem 10 magnesium oxide and 20% colloidal magnesium hydroxide precipitated in the presence of the flax fibers. Again, one set contained no ceramic fiber and the other contained 2.5% HSA fiber. Sidestream tar yields from cigarettes rerolled in these papers after treatment with a range of burning chemical concentrations are listed below:

| Composition Of Burning Chemical Solution | Sidestream Tar (mg/cigarette) | |
|---|---|---|
| | Without HSA Fiber | With HSA Fiber |
| 3% Sodium Acetate | 16.9 | 13.6 |
| 4% Potassium Acetate | 12.4 | 12.3 |
| 6% Potassium Acetate | 12.8 | 11.0 |
| 8% Potassium Acetate | 13.3 | 12.2 |

In this series, wrappers with HSA fiber gave less sidestream tar by an average of 1.6 milligram per cigarette than those with no ceramic fiber.

Many variations will become apparent to those skilled in the art and the invention is not limited to the preferred embodiments shown. Various modifications and changes may be made without departing from the spirit and scope of the invention as defined in the following claims.

I claim:

1. A wrapper for smoking articles such as cigarettes, cigars and the like comprising a cellulosic sheet containing a small percentage of ceramic fibers selected from the group consisting of polycrystalline alumina, aluminum-silicate, and amorphous alumina and as a filler magnesium hydroxide and/or magnesium oxide coated on or applied to the fibers of the sheet to form cigarette paper or cigar wrap.

2. The wrapper as defined in claim 1, wherein the ceramic fiber comprises 1% to 5% or more by weight of the total fibers of the sheet.

3. The wrapper as defined in claim 1, wherein the ceramic fiber comprises at least 2.5% by weight of the total weight of the sheet.

4. A wrapper as defined in claim 2, wherein the ceramic fibers comprise polycrystalline alumina.

5. A wrapper as defined in claim 4, wherein the ceramic fibers comprise aluminum-silicate.

6. A wrapper as defined in claim 4, wherein the ceramic fibers comprise amorphous alumina.

7. The wrapper of claim 1 wherein the ceramic fibers are 1.5 micrometers in average diameter or less.

8. A smoking article comprising a tobacco charge and a wrapper for the tobacco charge, said wrapper comprising a cellulosic sheet containing a small percentage of ceramic fibers selected from the group consisting of polycrystalline alumina, aluminum-silicate and amorphous alumina and as a filler magnesium hydroxide and/or magnesium oxide coated on or applied to the fibers of the sheet.

9. A smoking article as defined in claim 8, wherein the ceramic fiber comprises 1% to 5% or more by weight of the total weight of the sheet.

10. A smoking article as defined in claim 8, wherein the ceramic fiber comprises at least 3% by weight of the total fibers of the sheet.

11. A smoking article defined in claim 8, wherein the ceramic fiber comprises polycrystalline alumina.

12. A smoking article defined in claim 11, wherein the ceramic fiber comprises aluminum-silicate.

13. A smoking article defined in claim 11, wherein the ceramic fiber comprises amorphous alumina.

14. The smoking article of claim 8, in which the wrapper is cigarette paper.

15. The smoking article of claim 8 in which the wrapper is cigar wrap.

16. A smoking article of claim 8 in which the ceramic fibers are 1.5 micrometers in average diameter or less.

17. A method for reducing the visible sidestream smoke emanating from a smoking article comprising wrapping the tobacco charge in the smoking article in a combustible cellulosic sheet containing, a small percentage of ceramic fibers selected from the group consisting of polycrystalline alumina, aluminum-silicate and amorphous alumina and as a filler magnesium hydroxide and/or magnesium oxide coated on or applied to the fibers of the sheet.

18. The method as defined in claim 17, wherein the ceramic fiber comprises 1% to 5% or more by weight of the total weight of the sheet.

19. The method as defined in claim 17, wherein the ceramic fiber comprises at least 2.5% by weight of the total fibers of the sheet.

20. The method as defined in claim 17, wherein the ceramic fibers have an average diameter of 1.5 micrometer or less.

* * * * *